US011530581B2

(12) United States Patent
Meier et al.

(10) Patent No.: US 11,530,581 B2
(45) Date of Patent: Dec. 20, 2022

(54) WEIGHTED MATERIAL POINT METHOD FOR MANAGING FLUID FLOW IN PIPES

(71) Applicant: ExxonMobil Upstream Research Company, Spring, TX (US)

(72) Inventors: Holger A. Meier, Montgomery, TX (US); Shekhar V. Gosavi, Spring, TX (US); Sandeep Kumar, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 527 days.

(21) Appl. No.: 16/655,879

(22) Filed: Oct. 17, 2019

(65) Prior Publication Data

US 2020/0190923 A1 Jun. 18, 2020

Related U.S. Application Data

(60) Provisional application No. 62/780,614, filed on Dec. 17, 2018.

(51) Int. Cl.
*E21B 21/08* (2006.01)
*E21B 47/06* (2012.01)
(Continued)

(52) U.S. Cl.
CPC ..... *E21B 21/08* (2013.01); *E21B 47/06* (2013.01); *E21B 47/12* (2013.01); *E21B 49/0875* (2020.05)

(58) Field of Classification Search
CPC ..... E21B 21/08; E21B 47/06; E21B 47/12
(Continued)

(56) References Cited

U.S. PATENT DOCUMENTS 5,575,335 A * 11/1996 King ..... C09K 8/62 507/924
7,325,606 B1 * 2/2008 Vail, III ..... E21B 43/128 166/250.15

(Continued)

OTHER PUBLICATIONS

Zhang et al. (Material point method applied to multiphase flows, Journal of Computational Physics 227 (2008) 3159-3173) (Year: 2008).*

(Continued)

*Primary Examiner* — Iftekhar A Khan
(74) *Attorney, Agent, or Firm* — ExxonMobil Upstream Research Company—Law Department

(57) ABSTRACT

Methods and apparatus for managing fluid flow in pipes. An exemplary method includes initializing models of at least two fluid pads and one or more pipe elements, the models of the fluid pads comprising material points; for each of the material points, determining: an integration weight; and a material state; (a) for each of the fluid pads, discretizing governing fluid flow equations on a numerical grid, wherein the numerical grid is constrained within the pipe elements; (b) solving the discretized equations to generate nodal solutions; (c) constructing material point solutions from the nodal solutions; and until end criteria are met: updating the models of the fluid pads with the material point solutions; and repeating (a)-(c). An exemplary fluid flow data analysis system includes a processor and a display configured to display graphical representations of a fluid flow model, wherein the system is configured to manage fluid flow in pipes.

19 Claims, 4 Drawing Sheets

(51) Int. Cl.
*E21B 47/12* (2012.01)
*E21B 49/08* (2006.01)

(58) Field of Classification Search
USPC ..... 703/10
See application file for complete search history.

(56) References Cited

U.S. PATENT DOCUMENTS 9,135,475 B2 * 9/2015 Lecerf ..... E21B 43/17
9,323,503 B1 * 4/2016 Fontes ..... G06F 30/23
10,465,501 B2 * 11/2019 Friehauf ..... G01V 1/226
2008/0127712 A1 * 6/2008 Baker ..... G01F 1/60 73/1.16
2008/0128128 A1 * 6/2008 Vail ..... E21B 4/18 166/241.1
2008/0183451 A1 * 7/2008 Weng ..... E21B 43/267 166/250.1
2011/0120733 A1 * 5/2011 Vaidya ..... E21B 33/1208 166/387
2011/0303415 A1 * 12/2011 Todd ..... C09K 8/5045 507/236
2014/0222405 A1 * 8/2014 Lecerf ..... E21B 43/17 703/10
2014/0303950 A1 * 10/2014 Houeto ..... E21B 43/00 703/10
2017/0145793 A1 * 5/2017 Ouenes ..... E21B 49/00
2018/0306016 A1 * 10/2018 Safonov ..... C09K 8/60
2019/0120017 A1 * 4/2019 Getzlaf ..... E21B 34/14

OTHER PUBLICATIONS

Edwards et al. (Hydrodynamics of three phase flow in upstream pipes, Cogent Engineering (2018), pp. 1-28) (Year: 2018).*
Abe et al. (Material Point Method for Coupled Hydromechanical Problems, 2012, ASCE. 1-16) (Year: 2012).*
Dong et al. (Investigation of impact forces on pipeline by submarine landslide using material point method, Ocean Engineering 146 (2017) 21-28) (Year: 2017).*
Nikishkov, G.P., "Introduction to the Finite Element Method," University of Aizu, Aizu-Wakamatsu, 2004, Japan, 45 pages.
Kabanda, Patrick and Wang, Mingbo, "Numerical Simulation of Barite Sage in Pipe and Annular Flow," Hindawi, 2017, 21 pages.
Wang, Bin. et al., "Development of an implicit material point method for geotechnical applications," Computers and Geotechnics, 2015, Elsevier Ltd., 9 pages.

* cited by examiner

WEIGHTED MATERIAL POINT METHOD FOR MANAGING FLUID FLOW IN PIPES

CROSS-REFERENCE TO RELATED APPLICATION

This application claims the benefit of U.S. Provisional Application 62/780,614 filed Dec. 17, 2018 entitled "Weighted Material Point Method for Managing Fluid Flow in Pipes," the entirety of which is incorporated by reference herein.

FIELD

This disclosure relates generally to the field of hydrocarbon management and, more particularly, to understanding fluid flow in pipes related to hydrocarbon management. Specifically, exemplary embodiments relate to methods and apparatus for measuring, tracking, analyzing, predicting, and/or modeling fluid flow in pipes and the evolution thereof.

BACKGROUND

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Oil and gas production and distribution frequently involves fluid flow in pipes. For example, in the drilling of oil and gas wells, a wellbore is formed using a drill bit that is urged downwardly at a lower end of a drill string. Drilling fluid or mud may be pumped through the drill string to provide hydrostatic pressure to prevent formation fluids from entering into the wellbore, to keep the drill bit cool and clean during drilling, to carry-out drill cuttings, and to suspend the drill cuttings while drilling is paused and when the drilling assembly is brought in and out of the hole.

After drilling to a predetermined depth, the drill string and bit are removed, and the wellbore is lined with a string of casing. An annular area (the "annulus") is thus formed between the string of casing and the surrounding formations. Cement may be pumped into the annulus to create a permanent liner to protect and seal the wellbore. The process of drilling and then cementing progressively smaller strings of casing may be repeated multiple times until the well has reached the planned depth. The final string of casing, referred to as a production casing, is cemented into place.

As part of the completion process, the production casing is perforated at a desired level, typically at a zone of interest in the subsurface formation. This means that holes are shot through the casing and the cement sheath surrounding the casing. The perforations allow hydrocarbon fluids to flow into the wellbore. At times, the subsurface formation is fractured with fracking fluid and/or proppant solids. Carrier fluid may be utilized to carry proppant downhole and/or into the formation. Viscous carrier fluid, such as a gel, may be better at carrying the proppant, but may require higher pumping pressures than less-viscous fluid. Other types of carrier fluid may include foam, slickwater, and brine. Common additives to carrier fluid include hydrochloric acid (low pH can etch certain rocks, dissolving limestone for instance), friction reducers, guar gum, biocides, emulsion breakers, emulsifiers, 2-butoxyethanol, and radioactive tracer isotopes.

A variety of fluids may be pumped through the wellbore, such as water, gas, oil, mud, production fluids, treatment fluids, drilling fluid, cement, carrier fluid, etc. At times, a divider fluid pad will be pumped preceding or following a fluid operation. The divider fluid pad may clean the interior of the wellbore to prepare for the next fluid operation. The divider fluid pad may also be useful to track the location of the end (e.g., back end or top end) of the preceding fluid pad as the preceding fluid flows downhole.

Each fluid operation may be planned to treat a certain portion of the wellbore (or subsurface formation) for a certain duration and/or at a certain fluid pressure. Planning and executing fluid operations thus involves identifying fluid volumes, fluid weights, fluid flow rates, fluid loss into formation, fluid return from formation, miscibility of adjacent fluids, viscosity/solids-carrying ability of various fluids, and the requisite pumping pressures and times.

Heretofore, devices (e.g., darts) that can be readily identified by downhole sensors have been pumped with or in a fluid pad to provide an indication of the front/back end of the fluid volume. Fluid pads have often been over-estimated to allow for inaccuracies in the determination of the front/back end of the fluid volume. When an incorrect determination of a fluid's location is made, the result may be a weak cementing operation, an over-pressurized fracturing operation, fracturing an unplanned subsurface region, or even an imbalance of hydrostatic pressure leading to a blowout.

Numerical methods, based on algebraic or differential equations, have been utilized to simulate fluid flow in pipes. Some of these methods are grid-based, having stationary integration points at which fluid properties are evaluated. Common representatives are Bernoulli's equation or Euler/Navier-Stokes equations. Both of these types of methods allow for limited transport of material (e.g., proppant) and rheological data when only one fluid is present in the pipe. For example, an advection term may be included in the momentum and constitutive equations. However, these methods break down when a) the constitutive model cannot be formulated to include an advection term, and/or b) multiple moving fluids are present in the pipe.

It is conceivable that a combination of the known methods could be utilized to simulate multiple moving fluid pads in a pipe. However, each of the fluid pads would rely on a different material model. Therefore, the simulation would entail the change of the material model at each integration point as each fluid pad passes. While changing the material model is theoretically possible, available software is not equipped to do so, and adaptation would involve substantial software modifications. Available tools are thus incapable of modeling multiple different fluid pads flowing in a pipe.

It would be beneficial to better understand and/or model the flow of multiple fluids through pipes and the evolution thereof. Further, it would be beneficial to identify and/or predict the rheological properties and the position of the multiple fluids in the pipe over time.

BRIEF DESCRIPTION OF THE DRAWINGS

So that the manner in which the recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, which may admit to other equally effective embodiments.

DETAILED DESCRIPTION

Figure 1:
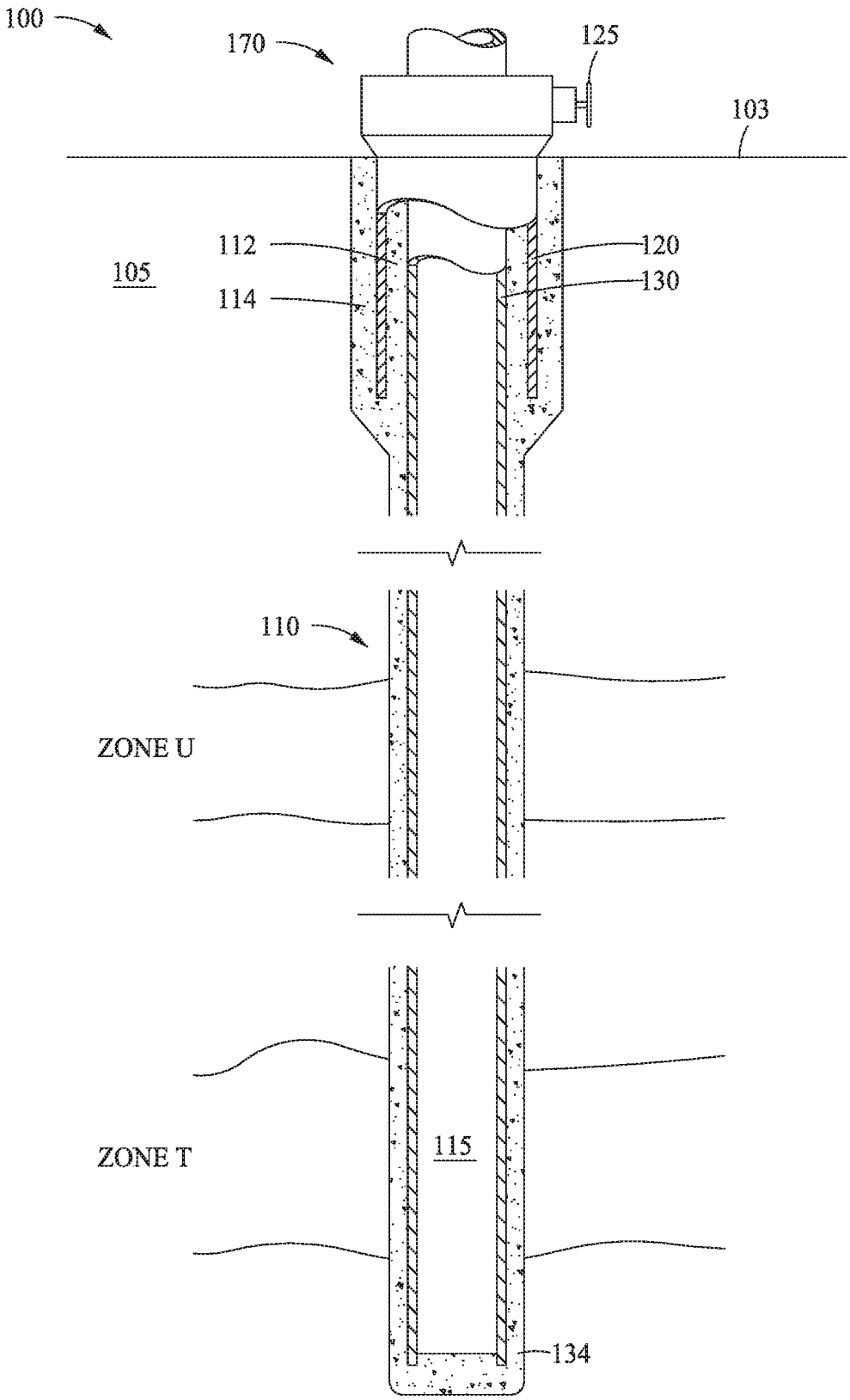
FIG. 1 illustrates a well site including pipes for wellbore fluid flow.

It is to be understood that the present disclosure is not limited to particular devices or methods, which may, of course, vary. It is also to be understood that the terminology used herein is for the purpose of describing particular embodiments only, and is not intended to be limiting. As used herein, the singular forms "a," "an," and "the" include singular and plural referents unless the content clearly dictates otherwise. Furthermore, the words "can" and "may" are used throughout this application in a permissive sense (i.e., having the potential to, being able to), not in a mandatory sense (i.e., must). The term "include," and derivations thereof, mean "including, but not limited to." The term "coupled" means directly or indirectly connected. The word "exemplary" is used herein to mean "serving as an example, instance, or illustration." Any aspect described herein as "exemplary" is not necessarily to be construed as preferred or advantageous over other aspects. The term "uniform" means substantially equal for each sub-element, within about ±10% variation.

"Axial" and/or "longitudinal" shall mean a direction along the length of an elongated structure, such as a wellbore. "Lateral" shall mean a direction perpendicular to the axial direction.

As used herein, "obtaining" data generally refers to any method or combination of methods of acquiring, collecting, or accessing data, including, for example, directly measuring or sensing a physical property, receiving transmitted data, selecting data from a group of physical sensors, identifying data in a data record, and retrieving data from one or more data libraries.

The term "simultaneous" does not necessarily mean that two or more events occur at precisely the same time or over exactly the same time period. Rather, as used herein, "simultaneous" means that the two or more events occur near in time or during overlapping time periods. For example, the two or more events may be separated by a short time interval that is small compared to the duration of the surveying operation. As another example, the two or more events may occur during time periods that overlap by about 40% to about 100% of either period.

As used herein, "hydrocarbon management" or "managing hydrocarbons" includes any one or more of the following: hydrocarbon extraction; hydrocarbon production, (e.g., drilling a well and prospecting for, and/or producing, hydrocarbons using the well; and/or, causing a well to be drilled to prospect for hydrocarbons); hydrocarbon exploration; identifying potential hydrocarbon-bearing formations; characterizing hydrocarbon-bearing formations; identifying well locations; determining well injection rates; determining well extraction rates; identifying reservoir connectivity; acquiring, disposing of, and/or abandoning hydrocarbon resources; reviewing prior hydrocarbon management decisions; hydrocarbon distribution, such as through cross-country pipelines, and any other hydrocarbon-related acts or activities. The aforementioned broadly include not only the acts themselves (e.g., extraction, production, drilling a well, etc.), but also or instead the direction and/or causation of such acts (e.g., causing hydrocarbons to be extracted, causing hydrocarbons to be produced, causing a well to be drilled, causing the prospecting of hydrocarbons, etc.).

As used herein, "fluid pad" or "pad" generally refers to a volume of fluid in a pipe. Unless stated otherwise, a fluid pad is assumed to be contiguous, such that separated volumes of the same fluid would be referred to as two separate fluid pads. When flowing in the downhole direction, the "front" of the fluid pad and the "bottom" of the fluid pad may be used interchangeably, and the "back" of the fluid pad and the "top" of the fluid pad may be used interchangeably. Likewise, when flowing in the uphole direction, the "front" of the fluid pad and the "top" of the fluid pad may be used interchangeably, and the "back" of the fluid pad and the "bottom" of the fluid pad may be used interchangeably. Whether stationary or flowing, any of the front, back, top, or bottom of the fluid pad may be referred to as an "end" of the fluid pad. Typically, intermixing of adjacent fluid pads will occur over an axial distance that is small in comparison with the axial extent of each of the fluid pads (e.g., about 10% or less). Therefore, the "end" of a fluid pad may be identified, for example, at a midpoint of the intermixing, if any.

If there is any conflict in the usages of a word or term in this specification and one or more patent or other documents that may be incorporated herein by reference, the definitions that are consistent with this specification should be adopted for the purposes of understanding this disclosure.

Understanding the flow behavior and/or rheological properties of fluids (e.g., laden, unladen, Newtonian, and non-Newtonian fluids) through pipes is important for hydrocarbon management operations. It may also be important to estimate and/or identify the position of the fluids along the pipe. For example, the position may be determined by estimating and/or identifying the front end and the back end of a fluid pad. Identifying the position of a fracking fluid in a pipe, for example, may be of particular interest during hydraulic fracturing operations. In many instances, the pipe may be filled with multiple fluid pads, each having different material properties, such as density or rheology. Fluids having different material properties may respond differently to similar pumping parameters. During hydrocarbon management operations, pumping schedules may need to be adjusted to accommodate specific material properties of various fluids.

One of the many potential advantages of the embodiments of the present disclosure is that different types of fluids within a pipe element (e.g., a one-dimensional pipe element) may be simulated. For example, simulations may provide an estimate or prediction of pressure at various locations within a wellbore. Another potential advantage includes simulations of fluid flow unrestricted by the dimensionality of the pipe element or the number or type of fluids. Another potential advantage includes the ability to simulate and/or predict the evolution of the it) fluid properties during flow through the pipe elements. Another potential advantage includes tracking of the positions of the various fluid pads in the pipe elements. Another potential advantage includes estimating the fluid pressures at various locations in the pipe elements. For example, if fluid pressures are better estimated, pumping equipment may be selected with more precision, allowing smaller, less expensive options. Embodiments of the present disclosure can thereby be useful in the discovery and/or extraction of hydrocarbons from subsurface formations.

FIG. 1 presents a side view of a well site 100 in cross-section. The well site 100 includes a wellhead 170 and a wellbore 110. The wellbore 110 includes a borehole 115, extending from the surface 103 of the earth, and into the subsurface 105. As illustrated, the wellbore 110 traverses at least zones of interest "T" and "U" within the subsurface 105. Although illustrated essentially linearly and vertically, it should be understood that wellbore 110 may include various bends and/or be disposed at various orientations within the subsurface 105. As such, terms such as "downhole" or "downward" should be understood to indicate wellbore locations or directions distal from wellhead 170, while terms such as "uphole" or "upward" should be understood to indicate wellbore locations or directions proximal to wellhead 170. It should be understood that the depth of the wellbore 110 may extend up to many thousands of feet below the surface 103. Typically, borehole 115 will contain, and/or be filled with, a variety of fluids, such as water, gas, oil, mud, production fluids, treatment fluids, drilling fluid, cement, carrier fluid, etc., generally referred to herein as "wellbore fluids."

In some embodiments, the wellbore 110 includes one or more strings of casing (e.g., surface casing 120, production casing 130). The casing strings may be secured in the wellbore 110, for example with cement sheath 112 and/or cement sheath 114. As illustrated, the production casing 130 has a lower end proximate a bottom 134 of the wellbore 110. In some embodiments, borehole 115 may be uncased or partially cased. In some embodiments, production casing 130 may be perforated or otherwise configured to provide fluid contact between borehole 115 and subsurface 105. As illustrated, the inner diameter of production casing 130 defines the width of borehole 115.

Wellbore 110 may include a variety of different types of fluid flow pipes at different times during operations. For example, the one or more strings of casing mentioned in reference to FIG. 1 may be fluid flow pipes. A drill string is another example of a fluid flow pipe. It should be appreciated that any tubular through which fluid flows as a part of hydrocarbon management operations may be considered a fluid flow pipe, regardless of size, material composition, or location. A portion of any such fluid flow pipe may be referred to herein as a "pipe element," which may or may not correspond to a physical pipe section and/or a computational pipe element. At times, the fluid(s) in wellbore 110 may be subject to, and/or flow as the net result of, one or more forces, such as gravity, downhole pumping, uphole pumping, and subsurface formation pressure.

In some embodiments, wellhead 170 includes a variety of valves, pipes, tanks, fittings, couplings, gauges, and other devices (e.g., one or more valves 125). For example, valves 125 may be used to selectively seal the wellbore 110. In some embodiments, the wellhead 170 may be connectable to hydrocarbon management equipment (e.g., pumps, top drives, etc.). The wellhead 170 and valves 125 may be used, for example, for flow control, pressure control, pumping, and/or hydraulic isolation during completion, rig-up, stimulation, rig-down, and/or shut-in operations. The wellhead 170 may be configured to allow tool strings and other downhole equipment to be run into and out of the wellbore 110 (e.g., using electric line, slick line, or coiled tubing). In some embodiments, wellhead 170 may be configured to allow deployable downhole equipment, such as plugs, balls, and/or carrier devices, to be deployed (e.g., dropped) into borehole 115 and/or retrieved therefrom.

In some embodiments, the flow of wellbore fluids through a pipe may be simulated. For example, procedures based on a Weighted Material Point Method (MPM) computation may be utilized to simulate the flow of wellbore fluids through a pipe. The simulation may include integration points for Weighted MPM that are not fixed in space. As such, the integration points that are not fixed in space may be referred to as "material points." (It should be understood that, from time to time, the fluid may be stationary in the pipe. Material points representative of a stationary fluid may thus be stationary, yet not fixed, and the rate of the fluid flow may be zero.) The simulation may include material points that are free to move along the pipe. In some embodiments, the material points may be used to track the movement of the material properties and/or rheological properties of the various fluid pads.

Generally, conventional MPM is a numerical technique used to simulate the behavior of solids, liquids, gases, and any other continuum material. In MPM, a continuum body may be described by a number of small Lagrangian elements referred to as "material points." These material points are typically surrounded by a background grid that is used to calculate gradient terms, such as the deformation gradient, for example. Unlike other grid-based methods (e.g., finite element method, finite volume method, or finite difference method), the MPM is categorized as a gridless, grid-free, continuum-based particle method. Despite the presence of a background grid, the MPM does not encounter many of the drawbacks of grid-based methods, such as high deformation tangling, advection errors, etc.

As used herein, Weighted MPM adapts MPM numerical techniques to fluid flow that is constrained within a pipe. For example, the pipe may be represented by a computational grid having finite dimensions and/or constrained boundary conditions (e.g., the computational grid may be constrained within pipe elements). In some embodiments, the model may represent a pipe with one or two open ends. In some embodiments, the model may represent a pipe with one or two fixed ends. In some embodiments, the model may represent a pipe with active pressure management (e.g., pumping) at one or two ends. In some embodiments, the model may represent a pipe of fixed diameter (or diameters, if the pipe diameter changes along its length). In some embodiments, the model may represent a pipe of changeable diameter (e.g., a rubber hose). In some embodiments, the model may represent a pipe of changeable length (e.g., a telescoping pipe).

Figure 2A:
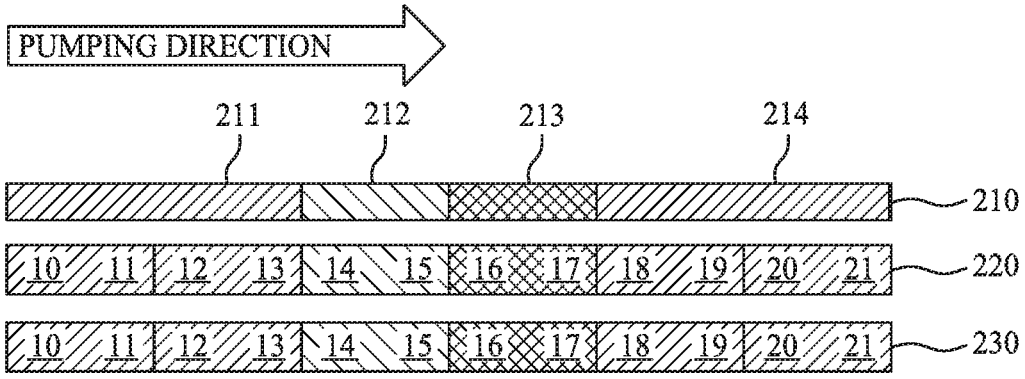
FIGS. 2A-2B illustrate a comparison of a Finite Element Method simulation to a Weighted Material Point Method simulation.
Figure 2B:
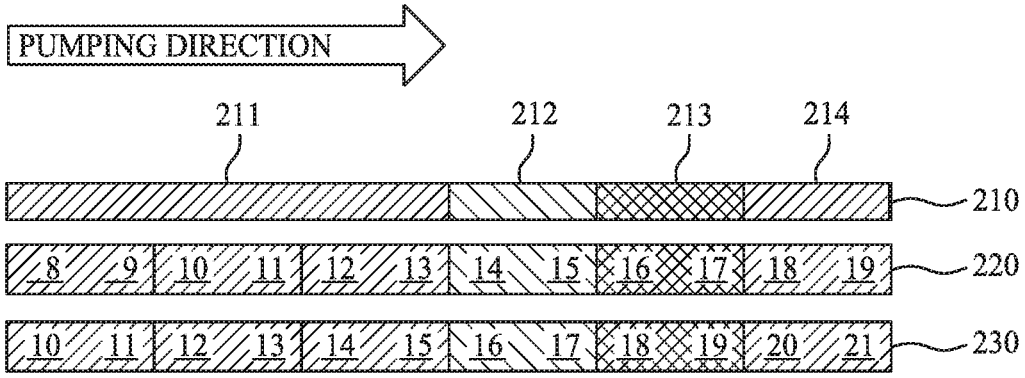

Weighted MPM simulations may be better understood in comparison to numerical methods having stationary integration points (e.g., finite element method (FEM)). FIGS. 2A-2B illustrate an application of the Weighted MPM simulation in comparison to an application of FEM. Row 210 of FIGS. 2A-2B represents four different fluid pads 211-214 in a pipe, flowing (e.g., being pumped) from the left side to the right side of the page. As illustrated, fluid pad 211 and fluid pad 214 are of the same material type, while fluid pads 212 and 213 are each of different material types. FIG. 2A illustrates the fluid pads at time $t_1$, while FIG. 2B illustrates the fluid pads at time $t_2$ (subsequent to time $t_1$). For example, fluid may be pumped through the pipe from left to right as time progresses from time $t_1$ to time $t_2$.

Row 220 of FIGS. 2A-2B illustrates the Weighted MPM material points representative of fluid pads 211-214. Row 230 of FIGS. 2A-2B illustrates the FEM integration points representative of fluid pads 211-214. Note that the Weighted MPM material points of row 220 move (e.g., from left to right) with the fluid pads 211-214 of row 210 as the simulation progresses from time $t_1$ to time $t_2$. Each Weighted MPM material point retains its material type from time $t_1$ to time $t_2$. Note that the FEM integration points of row 230 do not move as the simulation progresses from time $t_1$ to time $t_2$. Rather, the material type at integration points 14 and 15 changes from that of fluid pad 212 at time $t_1$ to that of fluid pad 211 time $t_2$. Likewise, the material type at integration points 16 and 17 changes from that of fluid pad 213 at time $t_1$ to that of fluid pad 212 time $t_2$, and the material type at integration points 18 and 19 changes from that of fluid pad 214 at time $t_1$ to that of fluid pad 213 time $t_2$.

For simplicity, the simulations illustrated in FIGS. 2A-2B assume that each computational pipe element (denoted by a box in rows 220 and 230) contains only one material type. In other words, the fluid-fluid interfaces are aligned with pipe element boundaries. However, in some embodiments, Weighted MPM simulations may position a fluid-fluid interface anywhere between or within the pipe elements.

In some embodiments, simulations and/or models based on Weighted MPM may be calibrated and/or validated with the use of downhole sensors. In some embodiments, the downhole sensors may include at least two pressure sensors: one at the wellhead (e.g., wellhead pressure gauge), and at least one downhole (e.g., downhole pressure gauge). Multiple downhole pressure sensors located along the pipe may increase the accuracy of the results. For example, a pressure sensor may be located every 1000 feet along the downhole pipe and communicatively coupled to provide real-time or near-real-time information to a fluid flow data analysis system.

Figure 3:
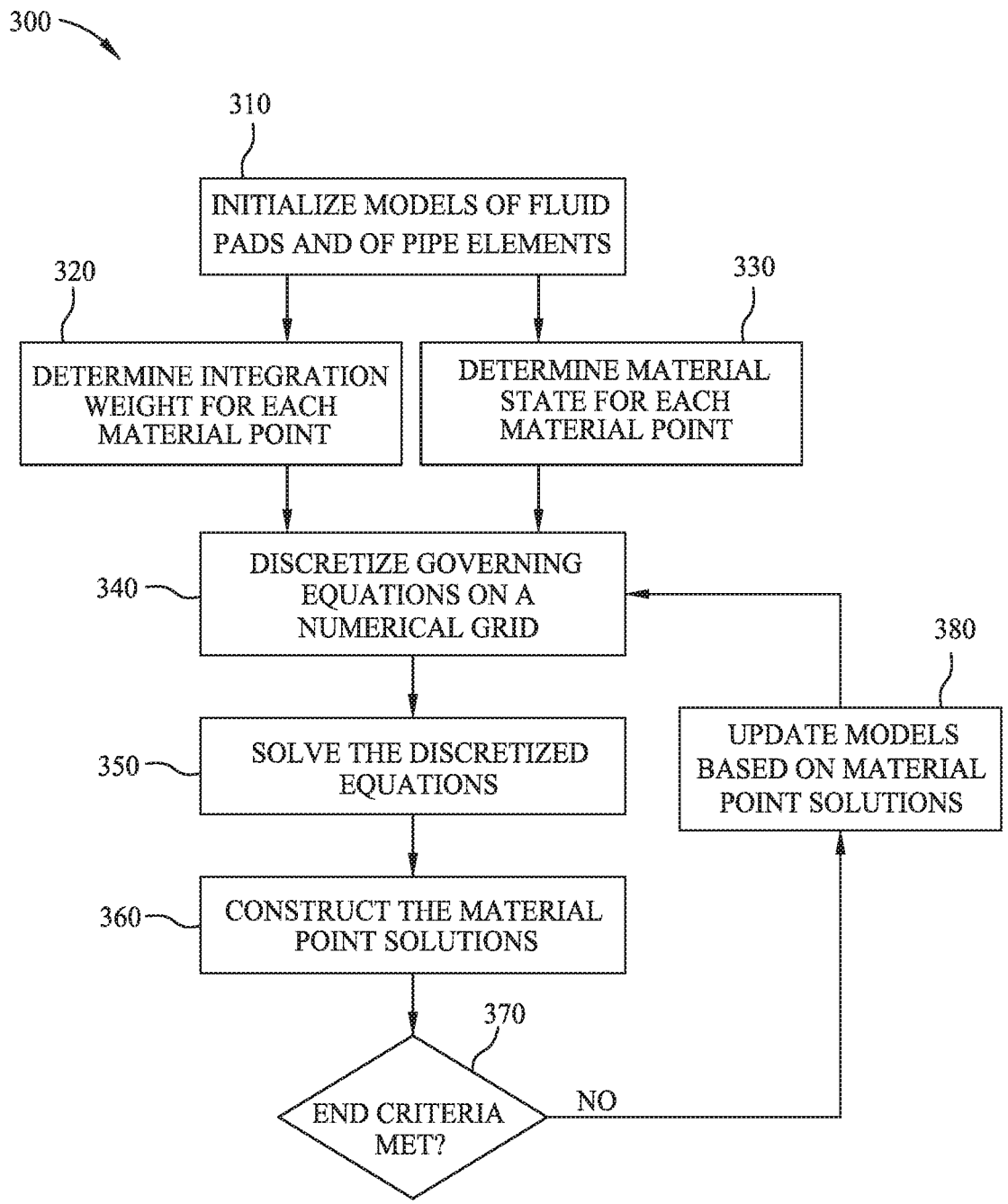
FIG. 3 is a flow chart for the Weighted Material Point Method.

FIG. 3 is a flow chart of a method 300 for implementing the Weighted MPM, according to embodiments disclosed herein. The method 300 begins at block 310 where models of the fluids and of the pipe are initialized. For example, N distinct fluid pads may be identified for simulation. For each of the N fluid pads, initialization of the model may include identification of material properties and/or rheological properties, such as material type, fluid volume, density, viscosity, elasticity, solids load, etc. Initialization of the model may also include identification of the order in which the N fluid pads will be (or have been) introduced into the pipe. In some embodiments, the location and/or timing of introduction may also be identified (e.g., fluid pad $N_1$ is introduced at the top of the pipe at time $t_1$; fluid pad $N_2$ is introduced at the top of the pipe at time $t_2$; and fluid pad $N_3$ is introduced at the bottom of the pipe at time $t_3$.) The computational grid of the pipe may also be initialized at block 310. For example, initialization of the model may include identification of P computational pipe elements along the length of the pipe. For each of the P pipe elements, initialization of the model may include identification of the physical properties of the pipe element, such as length, cross-sectional area, angle with respect to gravity, coefficient of friction of the interior surface, etc. Some of the physical properties may vary along the length of one or more of the pipe elements. Initialization of the model may also include identification of the order in which the P pipe elements are arranged to construct the pipe. Initialization of the models at block 310 may also include generating M initial material points for each of the N fluid pads. In some embodiments, the number of material points M may not be the same for each of the N fluid pads. In some embodiments, the number of material points M for one or more of the fluid pads may vary over time during the simulation. In some embodiments, the number of material points M may not be the same for each of the P pipe elements.

The method 300 continues at either block 320 or block 330, which may occur simultaneously or sequentially in either order. At block 320, an integration weight is determined for each of the M material points for each of the N fluid pads. In some embodiments, the integration weight may be determined by associating a volume to the material point. For example, in some embodiments, the weight function $w_M$ may be a real number associated with the volume $V_M$ of the material point (i.e., $w_M=V_M$). In some embodiments, the integration weight may be determined by identifying the location of the material point in the pipe and utilizing a numerical algorithm to determine the integration weight. For example, for each material point M, a weight function $w_M$ may be numerically evaluated at $x=x_M$:

$$\int_{\Omega} f(x)dv \approx \Sigma_M f(x_M)w_M \tag{1}$$

where $f$ is a function to be integrated. In some embodiments, $f$ is a vector of monomials that relate to the order of approximation used for the balance equations. In some embodiments, the integration weight may be computed numerically on a grid basis (e.g., cell-by-cell for the computational grid of the pipe).

At block 330, a material state is determined for each of the material points. For example, a stress and a strain rate value may be determined for each of the material points. The state of a material point may be defined by a set of thermodynamic variables, comprising but not limited to stress, strain rate, and internal variables. For example, the state of a material point may be expressed as:

$$\sigma_M^{n+1}=f(\sigma_M^n,\dot{\varepsilon}_M) \tag{2}$$

In some embodiments, an initial material state may be related to, and/or defined by, initial boundary conditions, which may be used to compute an equilibrium state inside the pipe. The initial material state may include strain rates, stress, pressures, etc., related to the initial boundary conditions. For example, the initial material state may depend on initial flow rates and/or pressures at the ends of the pipe. In some embodiments, the initial material state may be set based on sensor measurements, initial model assumptions, and/or prior simulations.

At block 340, the governing equations for fluid flow (e.g., Navier-Stokes equations or mass and momentum balance equations) are discretized. For example, the governing equations may be discretized on a numerical grid (e.g., the computational grid of the pipe) by using finite element shape functions $N_i(x)$ and specifying the properties (as initialized in block 310) and state (as determined in block 330) of the material points. The shape functions may be selected to fulfill the partition of unity, and to match the order of the shape functions to the order of the equations that they discretize. For example, the discrete equations may be expressed as:

$$F^{ext}=F^{int}, \text{ with } F_i^{int}\Sigma_M \text{grad}(N_i)\cdot\sigma_M^{n+1}w_M \tag{3}$$

The method 300 continues at block 350 where the discretized equations are solved. For example, the discretized equations (from block 340) may be solved by either an implicit or an explicit solving scheme. Solving the discretized equations may result in nodal solutions. Such nodal solutions may be, for example, one or more solutions that span the numerical grid (from block 340).

The method 300 continues at block 360 where material point solutions are constructed from the nodal solutions (from block 350). For example, material point solutions may be constructed by interpolating the nodal solution(s) of the discretized equations over the numerical grid (from block 340). For example, the material point solutions may be expressed as:

$$v_M = \Sigma_i N_i v_i \tag{4}$$

The method 300 continues at block 370 where the end criteria are checked. For example, the end criteria may be met after iterating through blocks 340, 350, 360 a selected number (e.g., 10, 20, 50, 100) of times. In some embodiments, the end criteria may be that the material point solutions change from those of the prior iteration by no more than a specified tolerance (e.g., 1%, 5%, 10%). Other common end and/or convergence criteria may be utilized at block 370.

If the end criteria are not met, the method 300 continues at block 380, wherein values for the models are updated based on the material point solutions of block 360. For example, the material points may be assigned updated positions. Updating material point positions may be expressed as:

$$x_M^{n+1} = x_M^n + v_M \Delta t \tag{5}$$

where $v_M$ is the velocity (flow rate) of the $M^{th}$ material point.

The method 300 may thus estimate and/or identify forces and/or pressures along the pipe as a function of time. In particular, the method 300 may estimate and/or identify forces and pressures at the ends of the pipe (e.g., pumping pressure, bottom-hole pressure).

It should be understood that Weighted MPM simulations may be equally applicable to managing fluid flow in surface pipes (e.g., cross-country pipelines) as to managing wellbore fluid flow in subsurface pipes. For example, fluid flow in surface pipes may be analyzed, simulated, and/or forecast with Weighted MPM simulations. While the prior discussion focused on wellbore pipes for simplicity, the concepts disclosed herein may be applied to any pipe useful to hydrocarbon management operations.

In practical applications, the present technological advancement may be used in conjunction with a fluid flow data analysis system (e.g., a high-speed computer) programmed in accordance with the disclosures herein. Preferably, in order to efficiently perform fluid flow modeling, the fluid flow data analysis system is a high performance computer ("HPC"), as known to those skilled in the art. Such high performance computers typically involve clusters of nodes, each node having multiple CPUs and computer memory that allow parallel computation. The models may be visualized and edited using any interactive visualization programs and associated hardware, such as monitors and projectors. The architecture of the fluid flow data analysis system may vary and may be composed of any number of suitable hardware structures capable of executing logical operations and displaying the output according to the present technological advancement. Those of ordinary skill in the art are aware of suitable supercomputers available from Cray or IBM.

Figure 4:
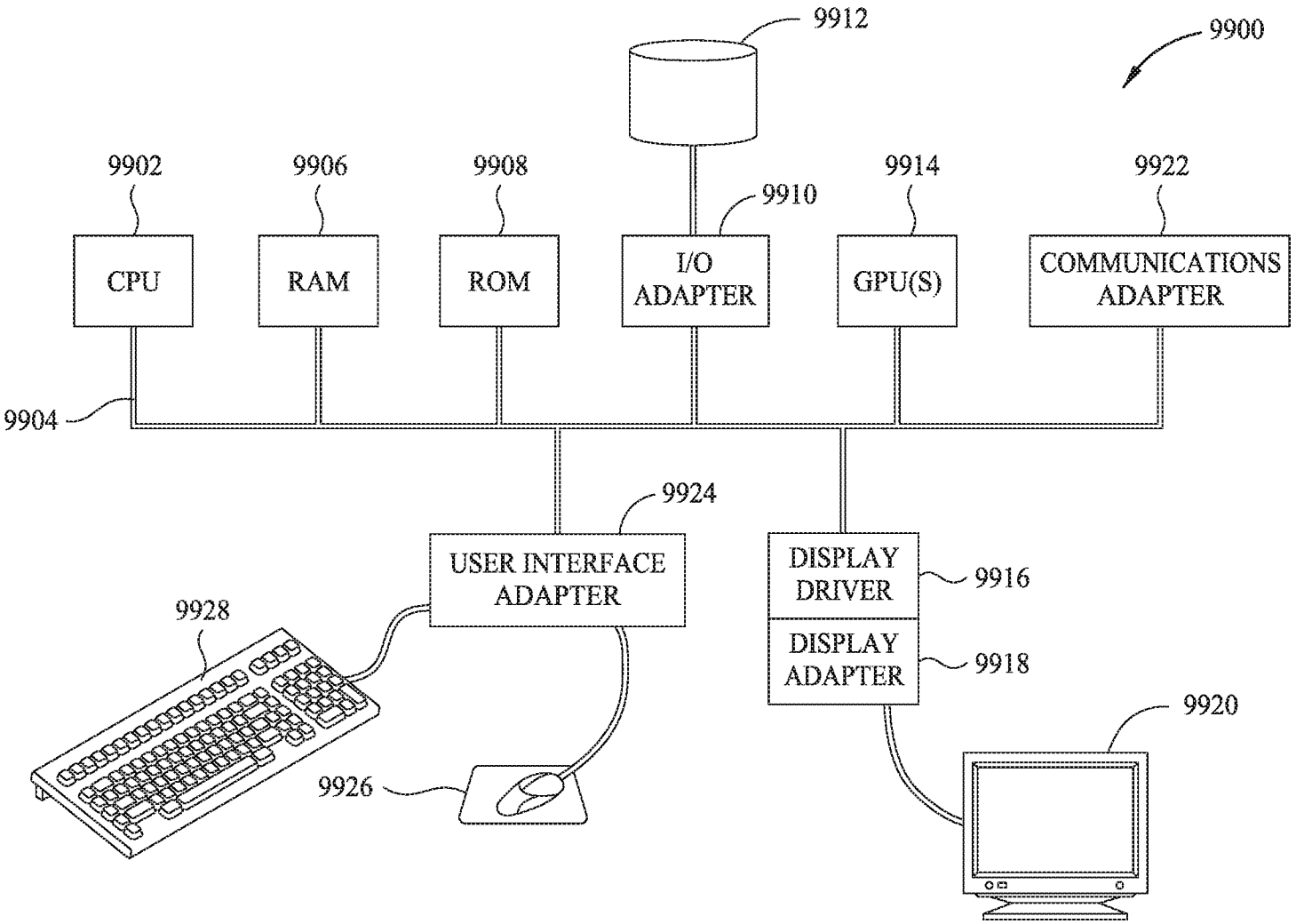
FIG. 4 is a block diagram of a fluid flow data analysis system upon which the Weighted Material Point Method may be embodied.

FIG. 4 is a block diagram of a fluid flow data analysis system 9900 upon which the present technological advancement may be embodied. A central processing unit (CPU) 9902 is coupled to system bus 9904. The CPU 9902 may be any general-purpose CPU, although other types of architectures of CPU 9902 (or other components of exemplary system 9900) may be used as long as CPU 9902 (and other components of system 9900) supports the operations as described herein. Those of ordinary skill in the art will appreciate that, while only a single CPU 9902 is shown in FIG. 4, additional CPUs may be present. Moreover, the system 9900 may comprise a networked, multi-processor computer system that may include a hybrid parallel CPU/GPU system. The CPU 9902 may execute the various logical instructions according to various teachings disclosed herein. For example, the CPU 9902 may execute machine-level instructions for performing processing according to the operational flow described.

The fluid flow data analysis system 9900 may also include computer components such as non-transitory, computer-readable media. Examples of computer-readable media include a random access memory ("RAM") 9906, which may be SRAM, DRAM, SDRAM, or the like. The system 9900 may also include additional non-transitory, computer-readable media such as a read-only memory ("ROM") 9908, which may be PROM, EPROM, EEPROM, or the like. RAM 9906 and ROM 9908 hold user and system data and programs, as is known in the art. The system 9900 may also include an input/output (I/O) adapter 9910, a communications adapter 9922, a user interface adapter 9924, and a display adapter 9918; it may potentially also include one or more graphics processor units (GPUs) 9914, and one or more display driver(s) 9916.

The I/O adapter 9910 may connect additional non-transitory, computer-readable media such as a storage device(s) 9912, including, for example, a hard drive, a compact disc ("CD") drive, a floppy disk drive, a tape drive, and the like to fluid flow data analysis system 9900. The storage device(s) may be used when RAM 9906 is insufficient for the memory requirements associated with storing data for operations of the present techniques. The data storage of the system 9900 may be used for storing information and/or other data used or generated as disclosed herein. For example, storage device(s) 9912 may be used to store configuration information or additional plug-ins in accordance with the present techniques. Further, user interface adapter 9924 couples user input devices, such as a keyboard 9928, a pointing device 9926 and/or output devices to the system 9900. The display adapter 9918 is driven by the CPU 9902 to control the display on a display device 9920 to, for example, present information to the user. For instance, the display device may be configured to display visual or graphical representations of any or all of the models discussed herein. As the models themselves are representations of fluid flow data, such a display device may also be said more generically to be configured to display graphical representations of a fluid flow data set, which fluid flow data set may include the models described herein, as well as any other fluid flow data set those skilled in the art will recognize and appreciate with the benefit of this disclosure.

The architecture of fluid flow data analysis system 9900 may be varied as desired. For example, any suitable processor-based device may be used, including without limitation personal computers, laptop computers, computer workstations, and multi-processor servers. Moreover, the present technological advancement may be implemented on application specific integrated circuits ("ASICs") or very large scale integrated ("VLSI") circuits. In fact, persons of ordinary skill in the art may use any number of suitable hardware structures capable of executing logical operations according to the present technological advancement. The term "processing circuit" encompasses a hardware processor (such as those found in the hardware devices noted above), ASICs, and VLSI circuits. Input data to the system 9900 may include various plug-ins and library files. Input data may additionally include configuration information.

The above-described techniques, and/or systems implementing such techniques, can further include hydrocarbon management based at least in part upon the above techniques. For instance, methods according to various embodiments may include managing hydrocarbons based at least in part upon models constructed according to the above-described methods. In particular, such methods may include constructing a well, operating a well, and/or causing a well to be constructed or operated, based at least in part upon the fluid simulations and models, which may optionally be informed by other inputs, data, and/or analyses, as well) and further prospecting for and/or producing hydrocarbons using the well.

The foregoing description is directed to particular example embodiments of the present technological advancement. It will be apparent, however, to one skilled in the art, that many modifications and variations to the embodiments described herein are possible. All such modifications and variations are intended to be within the scope of the present disclosure, as defined in the appended claims.

The invention claimed is:

1. A method for managing fluid flow in pipes, comprising:
initializing models of at least two fluid pads and of one or more pipe elements, the models of the fluid pads comprising material points;
for each of the material points, determining:
an integration weight; and
a material state;
(a) for each of the fluid pads, discretizing governing fluid flow equations on a numerical grid, wherein the numerical grid is constrained within the pipe elements;
(b) solving the discretized equations to generate nodal solutions;
(c) constructing material point solutions from the nodal solutions;
updating the models of the fluid pads with the material point solutions;
estimating a pressure at a wellbore location represented by the models of the pipe elements based on the updated models; and
based on the estimated pressure, causing a pumping rate to be adjusted.

2. The method of claim 1, further comprising:
measuring a pressure at a wellhead location and at a downhole location of the wellbore; and
calibrating at least one of the models of the fluid pads and of pipe elements with the estimated pressure and the measured pressures.

3. The method of claim 1, wherein the initializing the models of the fluid pads comprises at least one of:
identification of a material type for each of the fluid pads;
identification of a fluid volume for each of the fluid pads;
identification of a density for each of the fluid pads;
identification of a viscosity for each of the fluid pads;
identification of an elasticity for each of the fluid pads;
identification of material properties for each of the fluid pads;
identification of rheological properties for each of the fluid pads;
identification of a solids load for each of the fluid pads;
identification of an order in which the fluid pads will be introduced;
identification of a location of introduction for each of the fluid pads; and
identification of a timing of introduction for each of the fluid pads.

4. The method of claim 1, wherein the initialization of the models of the pipe elements comprises at least one of:
identification of a length for each of the pipe elements;
identification of a cross-sectional area for each of the pipe elements;
identification of an angle with respect to gravity for each of the pipe elements;
identification of a coefficient of friction of an interior surface for each of the pipe elements; and
identification of an order in which the pipe elements will be arranged.

5. The method of claim 1, wherein the constructing the material point solutions from the nodal solutions comprises interpolating the nodal solutions.

6. The method of claim 1, wherein the pipe elements represent portions of a wellbore.

7. A wellbore constructed by determining a bottom-hole pressure according to the method of claim 1, wherein the pipe elements represent portions of the wellbore, and the wellbore location is proximate a bottom of the wellbore.

8. A method of managing a pumping rate with the aid of a fluid flow data analysis system, the method comprising:
obtaining data related to an initial state of a plurality of pipe elements and a plurality of fluid pads within the pipe elements;
generating a pumping schedule with the fluid flow data analysis system for the plurality of fluid pads through the plurality of pipe elements, the pumping schedule being adjusted based on an estimated pressure at a location in the pipe elements, the pressure being estimated by:
initializing models of the fluid pads and of the pipe elements with the obtained data, the models of the fluid pads comprising material points;
for each of the material points, determining:
an integration weight; and
a material state;
(a) for each of the fluid pads, discretizing governing fluid flow equations on a numerical grid, wherein the numerical grid is constrained to the pipe elements;
(b) solving the discretized equations to generate nodal solutions;
(c) constructing material point solutions from the nodal solutions;
updating the models of the fluid pads with the material point solutions; and
adjusting the pumping rate based on the updated models.

9. The method of claim 8, wherein the pipe elements represent portions of a wellbore, the method further comprising:
measuring a pressure at a wellhead location and at a downhole location of the wellbore; and
calibrating at least one of the models of the fluid pads and of pipe elements with the estimated pressure and the measured pressures.

10. The method of claim 8, wherein the initializing the models of the fluid pads comprises at least one of:
identification of a material type for each of the fluid pads;
identification of a fluid volume for each of the fluid pads;
identification of a density for each of the fluid pads;
identification of a viscosity for each of the fluid pads;
identification of an elasticity for each of the fluid pads;
identification of material properties for each of the fluid pads;
identification of rheological properties for each of the fluid pads;

identification of a solids load for each of the fluid pads;
identification of an order in which the fluid pads will be introduced;
identification of a location of introduction for each of the fluid pads; and
identification of a timing of introduction for each of the fluid pads.

11. The method of claim 8, wherein the initialization of the models of the pipe elements comprises at least one of:
identification of a length for each of the pipe elements;
identification of a cross-sectional area for each of the pipe elements;
identification of an angle with respect to gravity for each of the pipe elements;
identification of a coefficient of friction of an interior surface for each of the pipe elements; and
identification of an order in which the pipe elements will be arranged.

12. The method of claim 8, wherein the constructing the material point solutions from the nodal solutions comprises interpolating the nodal solutions.

13. The method of claim 8, wherein obtaining the data comprises measuring at least one of pressure, temperature, and flow rate at a location in the pipe elements.

14. A fluid flow data analysis system comprising:
a processor; and
a display configured to display graphical representations of a fluid flow model, wherein the system is configured to:
initialize models of at least two fluid pads and of one or more pipe elements, the models of the fluid pads comprising material points;
for each of the material points, determine:
an integration weight; and
a material state;
(a) discretize governing equations on a numerical grid, wherein the numerical grid is constrained within the pipe elements;
(b) solve the discretized equations to generate nodal solutions;
(c) construct material point solutions from the nodal solutions;
update the models of the fluid pads with the material point solutions;
estimate a pressure at a wellbore location represented by the models of the pipe elements based on the updated models; and
cause a pumping rate to be adjusted based on the estimated pressure.

15. The system of claim 14, wherein the system is further configured to:
obtain a pressure measurement at a wellhead location and at a downhole location of the wellbore; and
calibrate at least one of the models of the fluid pads and of pipe elements with the estimated pressure and the measured pressures.

16. The system of claim 14, wherein the initializing the models of the fluid pads comprises at least one of:
identification of a material type for each of the fluid pads;
identification of a fluid volume for each of the fluid pads;
identification of a density for each of the fluid pads;
identification of a viscosity for each of the fluid pads;
identification of an elasticity for each of the fluid pads;
identification of material properties for each of the fluid pads;
identification of rheological properties for each of the fluid pads;
identification of a solids load for each of the fluid pads;
identification of an order in which the fluid pads will be introduced;
identification of a location of introduction for each of the fluid pads; and
identification of a timing of introduction for each of the fluid pads.

17. The system of claim 14, wherein the initialization of the models of the pipe elements comprises at least one of:
identification of a length for each of the pipe elements;
identification of a cross-sectional area for each of the pipe elements;
identification of an angle with respect to gravity for each of the pipe elements;
identification of a coefficient of friction of an interior surface for each of the pipe elements; and
identification of an order in which the pipe elements will be arranged.

18. The system of claim 14, wherein the constructing the material point solutions from the nodal solutions comprises interpolating the nodal solutions.

19. The system of claim 14, wherein the pipe elements represent portions of a wellbore.

* * * * *